United States Patent [19]

Koschorrek

[11] 4,140,825

[45] Feb. 20, 1979

[54] ARTIFICIAL THATCHED ROOF OF OVERLAPPING PLASTIC TUBES, AND METHOD AND APPARATUS FOR MAKING SAME

[76] Inventor: Max Koschorrek, Flörkendorfer Weg 2, 2405 Ahrensbök, Fed. Rep. of Germany

[21] Appl. No.: 794,590

[22] Filed: May 6, 1977

[30] Foreign Application Priority Data

May 6, 1976 [DE] Fed. Rep. of Germany ..... 2620044

[51] Int. Cl.[2] ..... E04D 9/00

[52] U.S. Cl. ..... 428/92; 156/72; 156/435; 428/95; 428/96

[58] Field of Search ..... 428/85, 92, 95, 96, 428/131, 137, 138, 435; 156/72, 325

[56] References Cited

U.S. PATENT DOCUMENTS 3,904,799 9/1975 Shorrock ..... 428/92

*Primary Examiner*—Marion E. McCamish

*Attorney, Agent, or Firm*—Sughrue, Rothwell, Mion, Zinn and Macpeak

[57] ABSTRACT

A material, such as a web, mat or slab is disclosed, for covering a surface of a building, for decorative purposes. It comprises a carrier layer or foil and elongate elements, especially small plastic material tubes, fixed thereto and disposed at an acute angle to the carrier layer. The elongate elements extending through the carrier layer are anchored to the back of the carrier layer by the portion at the back of the carrier layer. Additionally, there is disclosed a method of and apparatus for making such a material.

26 Claims, 9 Drawing Figures

Figure 1:
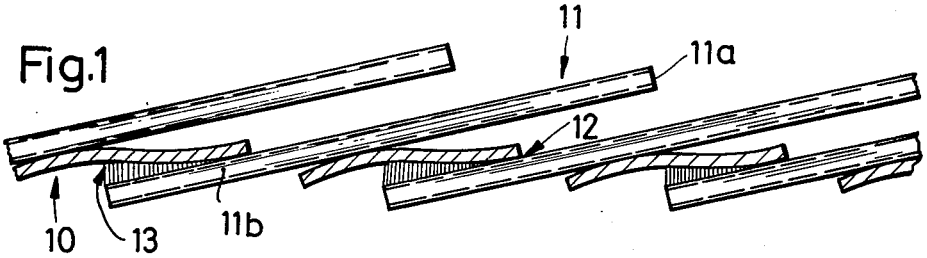

ARTIFICIAL THATCHED ROOF OF OVERLAPPING PLASTIC TUBES, AND METHOD AND APPARATUS FOR MAKING SAME

This invention relates to a material such as a web, mat or slab for covering surfaces of buildings, especially for decorative purposes, comprising a carrier layer consisting of a carrier layer or foil and elongate elements fixed thereto, more particularly small plastic tubes disposed at an acute angle to the carrier foil. The invention also relates to a method of and an apparatus for making the said material.

Webs, mats or slabs comprising tubes of plastic material or natural straw, reeds or the like disposed at an acute angle to a carrier layer have proved to be a particularly decorative covering for roof surfaces. This arrangement of the tubes and the alignment thereof so as to slope in relation to the eaves edge gives the optical impression of a thatched roof. If the materials are appropriately selected, the plastic material covering has numerous advantages over the natural products. More particularly, the fact that the web, slab etc. can be made under static conditions in the factory and that it can be laid on the roof of the building very easily and without complication must be stressed.

It is an object of the present invention further to develop and improve a material such as a web, mat or slab of the above type so that simple production is possible on a large scale industrially and with many applications and variations in respect of the construction of the end product.

According to the first aspect of the present invention there is provided a material, such as a web, mat or slab, for covering a surface of a building, for example for decorative purposes, which material comprises a carrier layer and elongate elements fixed thereto, more particularly small plastic tubes disposed at an acute angle to the carrier layer, the elongate elements extending through the carrier layer and being anchored to the back of the carrier layer by the portion which is at the back of the carrier layer, preferably a shorter end.

According to the second aspect of the present invention there is provided a method of making a material, such as a web, mat or slab, which method comprises passing elongate elements by one end through a prepunched carrier layer in the direction substantially at right angles thereto, whereafter they are folded over into a position at an acute angle to the carrier layer and are anchored to the back of the carrier layer.

According to the third aspect of the present invention there is provided an apparatus for performing the method in accordance with the second aspect, and for making material in accordance with the first aspect, of the invention which apparatus comprises means whereby elongate elements are adapted to be engaged by a centering and feed system and passed cyclically through the holes in the carrier layer.

The shorter end of the tubes may be anchored to the carrier layer foil in various ways, e.g. by gluing or by cold-welding using suitable solvents which dissolve the surfaces which are to be connected. Furthermore, a second layer or foil may be coated on the corresponding side of the carrier layer foil and acts at the same time as a covering and retaining means for the ends of the plastic material tubes. Finally, a continuous coating or layer may be applied, e.g. of plastic material, more particularly for example synthetic resin or bitumen. The ends of the tubes are partially or completely bonded in this layer or coating and thus fixed. In every case the resulting material is also sealed as a result of the fixing of the tube ends.

The material according to the invention may be used directly to cover the surfaces of buildings or the like, more particularly as a roof covering. Alternatively, the web or mat may be used as the external covering layer for a multi-layer element which may, for example, additionally have insulating and reinforcing slabs or the like. A flexible web or mat has the advantage of optimum adaptation to uneven building surfaces, e.g. curved parts of roofs, ridge edges, and so on.

Figure 2:
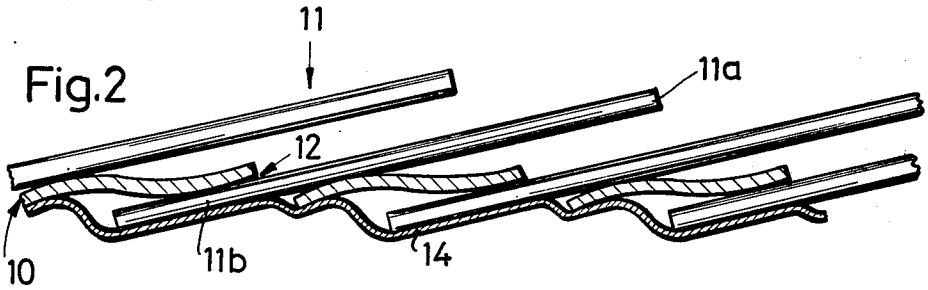
Figure 3:
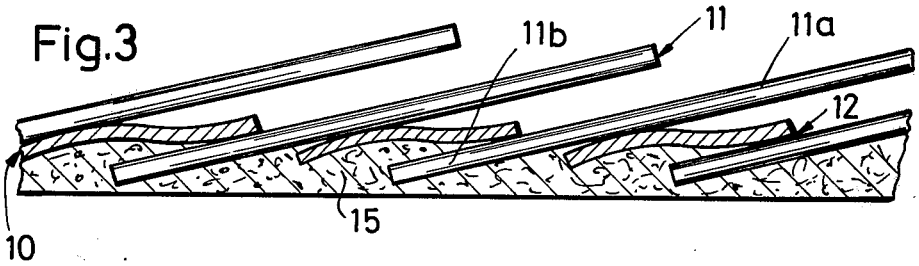
Figure 4:
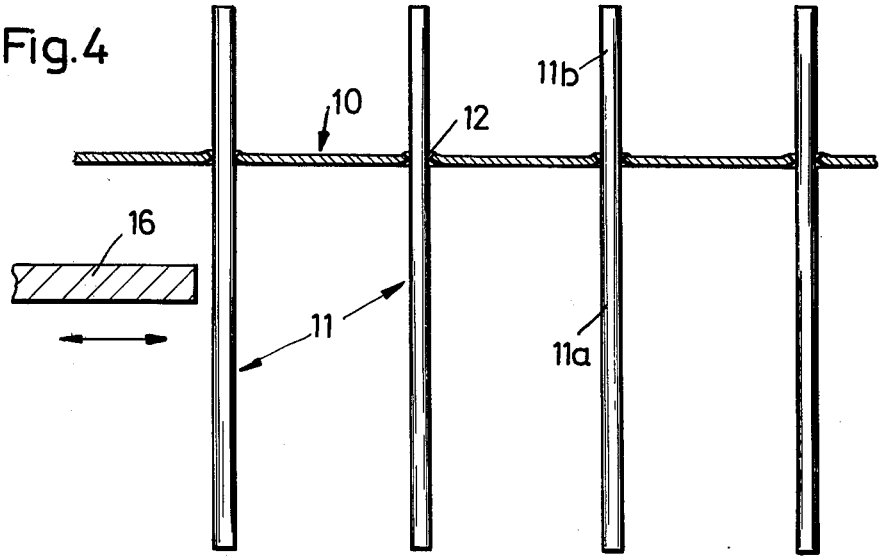
Figure 5:
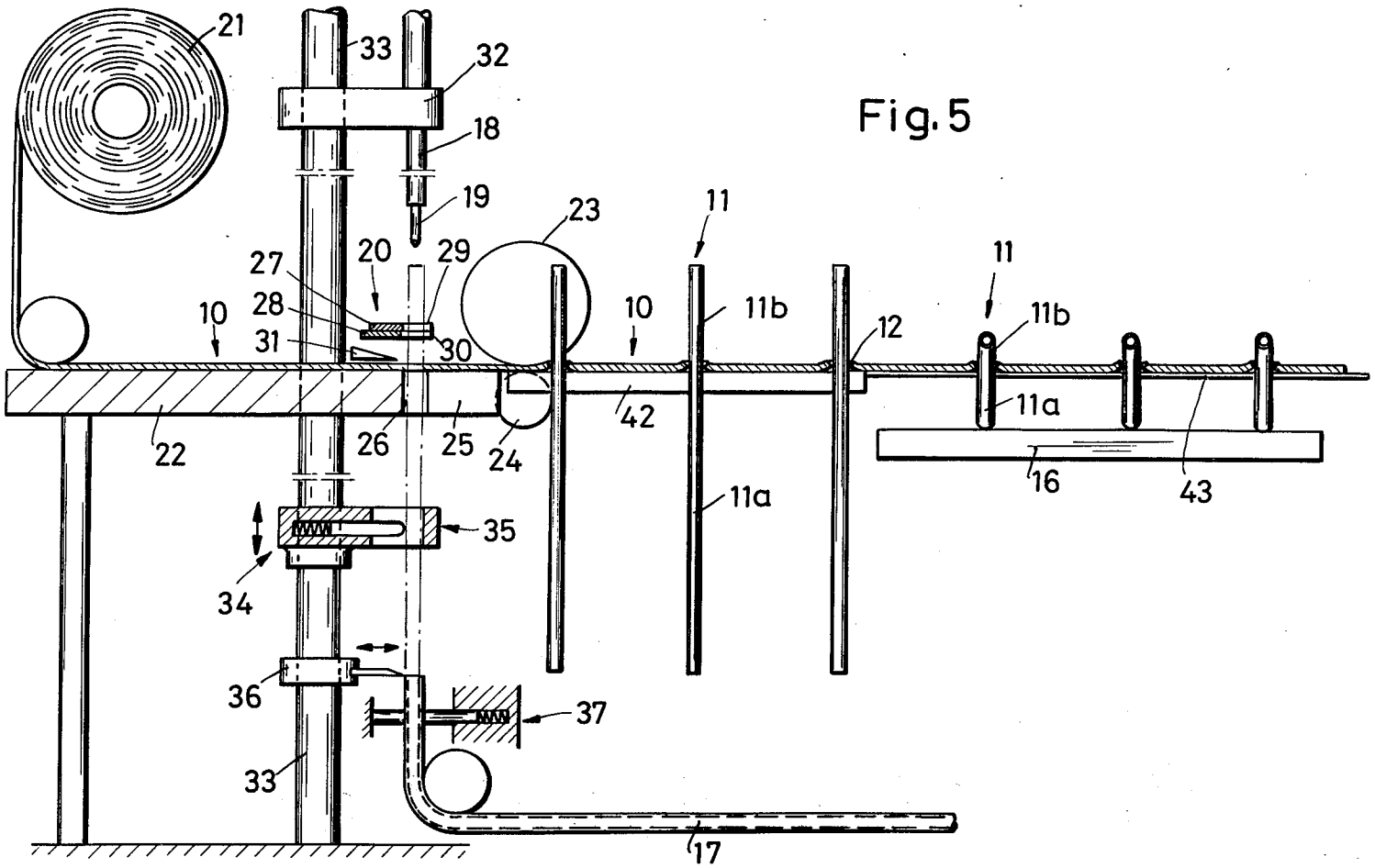
Figure 6:
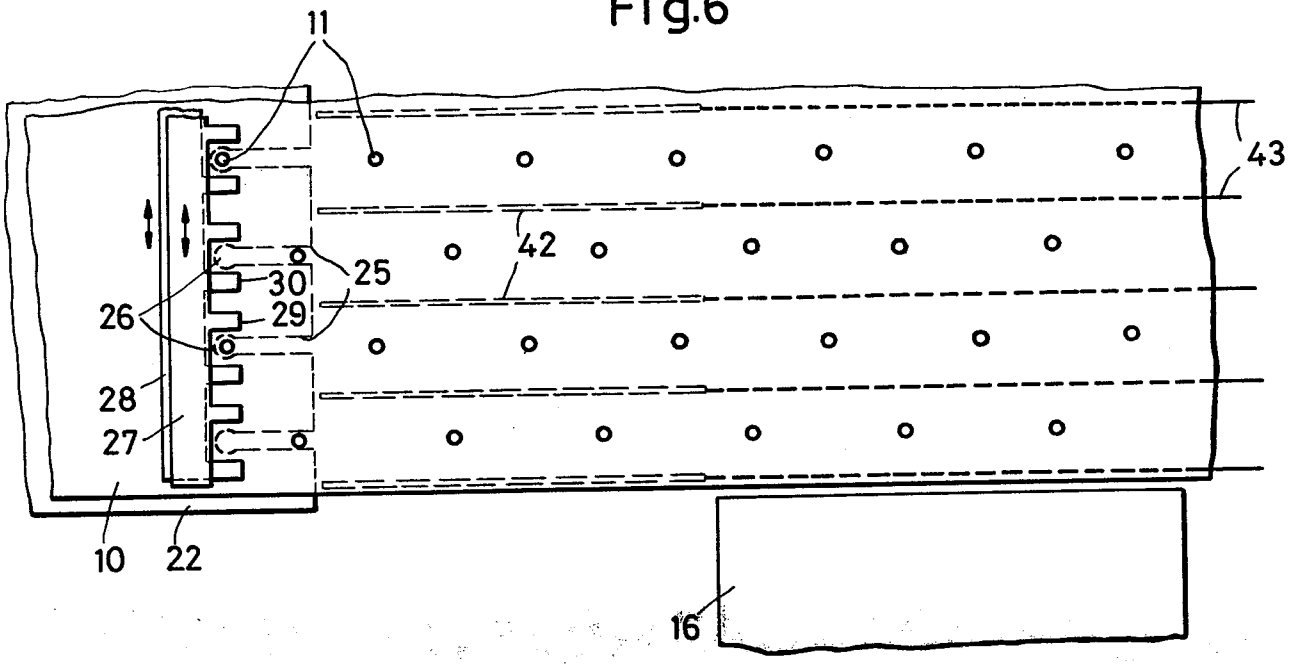
Figure 7:
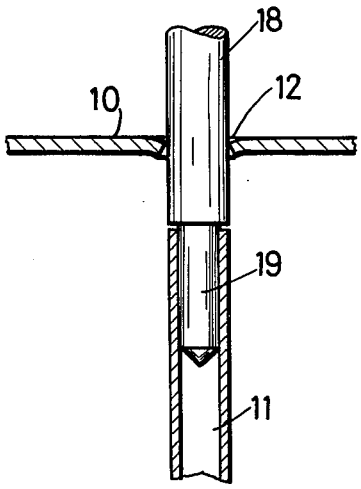
Figure 8:
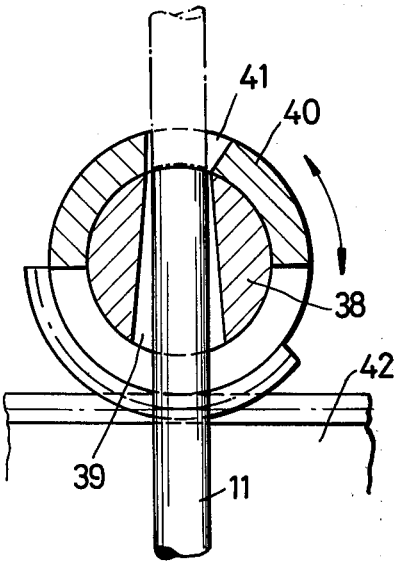
Figure 9:
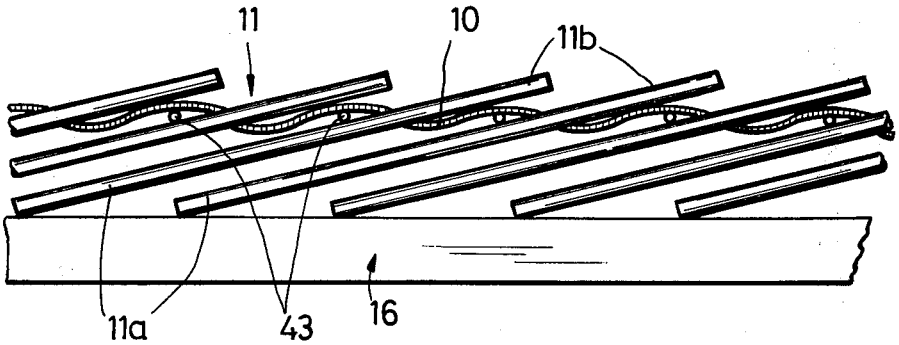

For a better understanding of the present invention and to show how the same may be put into effect, reference will now be made, by way of example, to the accompanying drawings, in which:

FIG. 1 shows a sectional view of a detail of a web or mat according to the invention, FIG. 2 shows a view similar to FIG. 1 of another exemplified embodiment, FIG. 3 shows another view, corresponding to FIGS. 1 and 2, showing a third exemplified embodiment, FIG. 4 shows a detail of a web or mat or the like during a stage in its manufacture, FIG. 5 shows a diagrammatic side elevational, partially sectional view of an apparatus for making a material according to the invention, FIG. 6 shows a plan view of part of the apparatus shown in FIG. 5, on an enlarged scale, FIG. 7 shows a mandrel for guiding the tube, as a detail of the apparatus, on an enlarged scale, FIG. 8 shows an apparatus for separating the tubes from a continuous length, again on an enlarged scale, and FIG. 9 shows a side elevational view of another part of the apparatus, during the folding-over of tubes.

In the simplest embodiment shown in FIG. 1, the webs, mats, slabs or the like according to the invention consist simply of a carrier layer, more particularly a carrier foil 10 of plastic material, and a plurality of elongate elements, more particularly small tubes 11, which also are a plastic material. The latter pass through the carrier foil 10 in the region of a hole 12 in the carrier foil. In the finished web, mat or the like, the tubes are directed at a very acute angle to the plane of the foil 10. The latter may also be deformed in the region where the tubes 11 pass therethrough. The element is also so constructed that the tubes 11 project from the carrier foil by a longer end **11*a* on the exposed side, that is the outside of the finished roof, while the side of the carrier foil 10 adjacent the surface of the building or the like shows shorter ends 11*b* of the tubes 11. These ends are rigidly connected to the carrier foil 10, that is to the back thereof. In the exemplified embodiment shown in FIG. 1, the ends 11*b* of the tubes 11 are anchored by adhesive 13 disposed in the region of the ends 11*b***. The adhesives may be solvents which dissolve the regions which are to be connected.

In the embodiment shown in FIG. 2, the ends **11*b* of the tubes 11 are anchored at the back of the carrier foil 10 by means of a fixing foil 14 which is additionally coated thereon. Foil 14** may consist of plastic material and, for example, be shrunk into place. Alternatively, the fixing foil may be self-adhesive or provided with a suitable adhesive.

In the embodiment shown in FIG. 3, the ends **11*b* of the tubes 11 are fixed by an anchoring layer 15 which is poured on or applied in a deformable state. For example, it may consist of a casting resin or bitumen. The thickness of this anchoring layer 15 may be so selected that the ends 11***b* are completely embedded. Alternatively, they can extend through the anchoring layer 15. The material selected for the layer 15 is advantageously one which ensures flexibility of the web, mat or the like arranged in this way.

The webs, mats or the like constructed according to FIGS. 1 to 3 may be disposed directly on the surface requiring to be covered, for example a roof surface. Alternatively, additional layers may be disposed on the anchored side of the tubes 11, more particularly insulating layers, for example glass wool, rock wool or foam plastic materials. A special effect in this connection is that the foil 10 together with the anchoring means for the tubes 11 provides a completely sealed covering, so that moisture-sensitive layers may be disposed beneath such covering.

A procedure to produce the mats, webs or the like is as follows as shown in FIG. 4. The shorter ends 11*b* of the tubes 11 are passed through the horizontally situated or guided carrier foil 10, preferably from below, and in an upward movement substantially perpendicularly to the foil 10. The tubes 11, which are then held upright in an intermediate position in the holes 12, are then folded over jointly or in rows into the inclined position, for example by pushing means 16 in the form of a plank. This holds the tubes 11 in the folded-over position initially until the shorter ends 11*b* have been fixed on the top side in one or other way as described. There is no risk of relative shifts of the tubes 11 in relation to the foil 10 in these conditions because the tubes 11 are under stress in the holes 12 due to the elasticity of the foil 10.

In this exemplified embodiment, shown in FIG. 5 the tubes 11 are cut from endless tube lengths 17, advantageously with different lengths of the longer ends 11*a*. This enhances the desired impression of irregularity on the exposed side. Specifically, a group of mandrels 18 disposed in a transverse row is pushed through the carrier foil 10 from the top thereof, said foil 10 resting on a table 22 and being intermittently transported. This forms the holes 12 for the subsequent passage of the tubes 11. The ends of the tubes 11 still connected to the tube lengths 17 are held in readiness at the underside of the foil 10, that is beneath the table 22, so that the reduced-diameter end 19 of the mandrels 18 enter the facing end of the tube lengths 17. The end 19 of mandrel 18 is so dimensioned with respect to the remainder thereof that the ends of the tube lengths 17 pushed on to the mandrels 18 are externally flush with the remainder of the mandrel, as shown in FIG. 7.

As soon as the ends of the tube lengths 17 have been engaged by the mandrels 18 in this way, the mandrels are moved upwards. At the same time, the tube lengths 17 are pushed on accordingly and pushed with the mandrels 18 through the foil 10. In a position corresponding to the required amount of end 11*b* above the foil 10, the tube lengths 17 are instantaneously fixed by a retainer 20. The mandrels can then be removed from the ends of the tube lengths 17 on a further upward movement. A portion of the tube lengths 17 corresponding to the required length of end 11*a* is severed beneath the table 22. The foil 10 is then advanced by a portion corresponding to the distance between the rows of tubes, and the above process is repeated.

FIGS. 5 and 6 diagrammatically illustrate apparatus for performing the above operation. The carrier foil 10 is drawn from a reel 21 and transported cyclically on the table 22 by means of two groups of conveyor rollers 23 and 24 disposed at the front end. The end zone of table 22 facing these conveyor rollers 23 and 24 is constructed in the form of a comb as a result of the provision of slots 25 with widenings 26 for the passage of the tubes. The width of the slots 25 is so selected that the tubes 11 held in the upright position can pass through these slots 25.

The retainer 20 for the tubes is disposed above this comb-like zone of the table 22. It consists of two relatively displaceable strips 27 and 28 provided with clamping elements 29 and 30 facing the tubes 11. The tubes 11 are instantaneously fixed between each pair of clamping elements 29 and 30 by appropriate relative shift of the strips 27 and 28.

A member 31 for holding the foil 10 down as the tubes 11 pass therethrough may be disposed beneath the retainer 20 and be constructed in a suitable manner.

The row of mandrels 18 extending transversely of the direction of conveyance is disposed on a common carrier 32 mounted for vertical displacement on fixed supports 33. Downward movement of the carrier 32 from the position shown in FIG. 5 causes the mandrels 18 to pass through the foil 10 in the region of the widenings 26 of the slots 25.

Beneath the table 22 is a vertically movable unit 34, advantageously on the support 33, which continues appropriately. Unit 34 is provided with a tube clamp 35. The object of this is to re-engage the free ends of the tube lengths 17 and supply them to the mandrels 18 as they arrive. As soon as the ends of the tube lengths 17 fit on the mandrels 18, the unit 34 and hence the tube clamp 35 with the mandrels 18 and tube lengths 17 is moved upwards, so that the tube lengths 17 together with the mandrels 18 are pushed through the prepunched foil 10.

Unit 34 also includes a separator 36, by means of which the tubes 11 are cut from the tube lengths 17 as soon as the required relative position has been reached with respect to the carrier foil 10.

A stationary tube brake 37 is disposed beneath the unit 34 to prevent the ends of the tube lengths 17 from being pulled back after the tubes 11 have been severed.

The above-mentioned parts of the apparatus are shown simply diagrammatically in the drawing. They may be constructed in various ways. FIG. 8 shows an example of a possible construction of the separator 36. Referring to FIG. 8, the tube 11 or tube lengths 17 passes through a spindle 38 with a diagonal guide aperture 39. A bush 40 is mounted for rotation on the spindle 38 and has a bore 41 which is in alignment with the guide aperture 39 on the passage of the tube 11 or tube lengths 17. Rotation of the bush 40 on the spindle 38 causes the inner edges of the bore 41 facing the spindle 38 to act as shearing edges to separate the part of the tube length 17 projecting from the guide aperture 39.

On leaving the table 22, the carrier foil 10 having been provided with tubes 11 in the manner described is first conveyed to upright webs 42 extending in the direction of conveyance. These webs are so disposed that the tubes 11 introduced in longitudinal and transverse rows — offset from one another in each case — are guided between said webs 42.

The zone of the webs 42 shown in FIG. 6 is followed by a section with wires 43 stretched in the direction of conveyance as a support for the foil 10. There is a substantially free space beneath the foil 10 in the region of these wires 43 so that the member 16 can act on the tubes 11 in this zone so that they are moved out of the upright position into the oblique position with respect to the foil 10. The tubes 11 are held in this position by the member 16 until the ends 11*b* have been fixed to the top of the foil 10. This operation is shown in detail in FIG. 9.

Instead of a member 16 in the form of a plank as described here, the individual tubes 11 may be pivoted into the inclined position by other means, for example by rod-like elements associated with each longitudinal or transverse row. In this way, it is possible to make an individual selection for the relative positions of the tubes 11 with respect to the foil 10, for example so that when roof surfaces are covered the tubes facing the ridge side are not exactly in a line at right angles to the eaves or ridge edge, but are at an angle thereto, as is conventional in the case of a natural thatched roof.

I claim:

1. An artificial thatched roof material for covering a surface of a building comprising, a plurality of elongated plastic tubes, a carrier layer having weather exposed and back roof sides, said elongate tubes being fixed thereto and disposed at acute angles to said carrier layer, the elongate tubes extending through the carrier layer and being secured to the back roof side of the carrier layer by their shorter ends which are disposed adjacent the back roof side of the carrier layer, whereby the longer ends of said tubes overlap each other and overlie the weather exposed side of the carrier layer.

2. The material of claim 1, in which the elongate elements are small plastic tubes.

3. The material of claim 2, in which the carrier layer defines holes for the passage of the elongate tubes which are smaller than the diameter of the tubes so that the edge of the hole encloses the tubes in the stressed state.

4. The material of claim 2, in which the tubes are fixed by an anchoring layer or an anchoring coating being applied to the back of the carrier layer.

5. The material of claim 4, in which the anchoring layer is selected from compact and foamed layers.

6. The material of claim 4, in which the anchoring coating essentially consists of a coating of plastics material applied to the carrier layer, preferably a plastics material which is flexible after setting, such as a casting resin.

7. The material of claim 4, in which the anchoring layer comprises a member selected from the group consisting of a web, a fixing foil, and a shrink foil, which is applied, by either adhesives or welding, and which is itself connected both to the carrier layer and to the ends of the tubes extending through the carrier layer.

8. The material of claim 1, in which the ends of the elongate tubes, directed at an acute angle to the carrier layer, are secured by adhesives or cold-welding to the carrier layer.

9. The material of claim 1, in which the elongate tubes are arranged to diverge from one another when seen in plan view of the material.

10. The material of claim 1, in which further layers and coatings are applied to the back of the material for insulating and reinforcing the material.

11. A method of making an artificial thatched roof material for covering a surface of a building, which method comprises the steps of; passing elongate plastic tubes by one end through a pre-punched carrier layer in a direction substantially at right angles thereto, folding said tubes over into an overlapping position at an acute angle to the carrier layer, and securing the shorter ends of said tubes to the back roof side of the carrier layer.

12. The method of claim 11, in which the elongate elements are small plastic tubes.

13. The method of claim 12, in which the tubes are passed through the carrier layer in groups, preferably in rows extending continuously over the width of a carrier layer.

14. The method of claim 13, in which a zone of tubes passing through the carrier layer and consisting of a number of groups, more particularly rows, of tubes, is jointly folded over into a position at an acute angle to the carrier layer.

15. The method of claim 11, in which the elongate tubes are severed from a continuous tube length, preferably with different lengths from one tube to another.

16. The method of claim 15, in which a number of continuous tube lengths corresponding to the number of tubes per group is fed to the carrier layer.

17. The method of claim 16, in which the tubes connected to the continuous length are passed through the carrier layer, instantaneously held, and then severed from the tube lengths.

18. Apparatus for making an artificial thatched roof covering material including a plurality of elongated plastic tubes extending through a carrier layer and having their longer ends disposed in an overlapping arrangement on the exposed weather side of said carrier layer and their shorter ends secured to the back roof side thereof, comprising; means for centering the elongate plastic tubes, means for feeding said tubes to the centering means, and means for individually and cyclically passing said tubes through spaced holes in the carrier layer.

19. The apparatus of claim 18, in which the centering means comprises mandrels for entering the free ends of the tubes and for drawing and guiding the tubes through the carrier layer.

20. The apparatus of claim 19, in which the mandrels are constructed with pointed ends to make the holes for the passage of the elongate plastic tubes through the carrier layer.

21. The apparatus of claim 20, in which the mandrels are adapted to pass from above through the carrier layer while producing the holes and are adapted to the introduced, on the opposite side of the carrier layer, into the ends of the tube lengths held in readiness.

22. The apparatus of claim 21, in which the ends of the tubes, fitted on the free ends of the mandrels, are adapted to be engaged together with the mandrels, by a feed element, said feed element comprising a tube clamp, which engages around the outside of and elastically clamps the tube lengths, and which is adapted to be advanced in the direction of the carrier layer by said feed element.

23. The apparatus of claim 19, in which, prior to separation from the tube length, the ends of the tubes pushed through the carrier layer are adapted to be fixed by a retainer and the mandrels are withdrawable from the ends of the tubes.

24. The apparatus of claim 18, in which the elongate elements mounted in the holes of the carrier layer are pivotable into an inclined acute angle position in the region of a support for the carrier layer, said support comprising wires extending in the direction of conveyance.

25. The apparatus of claim 24, in which the tubes are adapted to be subjected to the action of a folding element for folding the tubes into said inclined position beneath the carrier layer in the region of the longer ends of the tubes, said folding element comprising pusher means movable transversely of the direction of conveyance of the carrier layer.

26. The apparatus of claim 25, in which the tubes are fixed in the inclined position until securing means have been applied to the top of the carrier layer for anchoring the shorter ends of the tubes, such fixing being provided by the pusher means.

* * * * *